US008707832B2

(12) United States Patent
Liau

(10) Patent No.: US 8,707,832 B2
(45) Date of Patent: Apr. 29, 2014

(54) DRIVING HEAD FOR OPEN WRENCH

(76) Inventor: Jia-Guann Liau, Taichung (TW)

( * ) Notice: Subject to any disclaimer, the term of this patent is extended or adjusted under 35 U.S.C. 154(b) by 71 days.

(21) Appl. No.: 13/604,647

(22) Filed: Sep. 6, 2012

(65) Prior Publication Data

US 2014/0060261 A1 Mar. 6, 2014

(51) Int. Cl.
*B25B 13/00* (2006.01)
*B25B 13/48* (2006.01)
*B25B 13/02* (2006.01)

(52) U.S. Cl.
CPC ..... *B25B 13/02* (2013.01)
USPC ..... 81/125.1; 81/176.1

(58) Field of Classification Search
CPC ..... B25B 13/02
USPC ..... 81/125.1, 176.1
See application file for complete search history.

(56) References Cited

U.S. PATENT DOCUMENTS

2002/0092384 A1* 7/2002 Shih-Kuei ..... 81/125.1
2010/0269642 A1* 10/2010 Feraud et al. ..... 81/121.1
2011/0048177 A1* 3/2011 Lin ..... 81/58

* cited by examiner

*Primary Examiner* — Monica Carter
*Assistant Examiner* — Danny Hong

(57) ABSTRACT

An open wrench includes integral handle and first driving head. The first driving head has a U-shaped body which has a mounting hole defined therein and an opening communicates with the mounting hole. Each of top surface and bottom surface of the first driving head has a first face and a second face. The second face is a U-shaped face and located along with the mounting hole. The first face is a U-shaped face and located outside of the second face. A U-shaped groove is defined between the first and second faces.

14 Claims, 6 Drawing Sheets

DRIVING HEAD FOR OPEN WRENCH

FIELD OF THE INVENTION

The present invention relates to an open wrench, and more particularly, to a driving head for an open wrench.

BACKGROUND OF THE INVENTION

The conventional open wrench generally includes a driving head connected to a handle. In order to save material required, the driving head of the open wrench is designed to have grooves so as to reduce the material. A known open wrench is disclosed in U.S. Pat. No. 463,137 and has two driving heads on two ends of the handle and each driving head has grooves so as to reduce the material required. However, the top surface is parallel to the bottom surface of the driving head is even and the thickness from the top surface to the bottom surface is fixed. This cannot save too much material.

The present invention intends to provide a driving head for an open wrench to reduce material required.

SUMMARY OF THE INVENTION

The present invention relates to an open wrench and comprises integral handle and first driving head. The first driving head has a U-shaped body which has a mounting hole defined therein and an opening communicates with the mounting hole. Each of top surface and bottom surface of the first driving head has a first face and a second face. The second face is a U-shaped face and located along with the mounting hole. The first face is a U-shaped face and located outside of the second face. A U-shaped groove is defined between the first and second faces.

The primary object of the present invention is to provide an open wrench which is shaped to save material.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
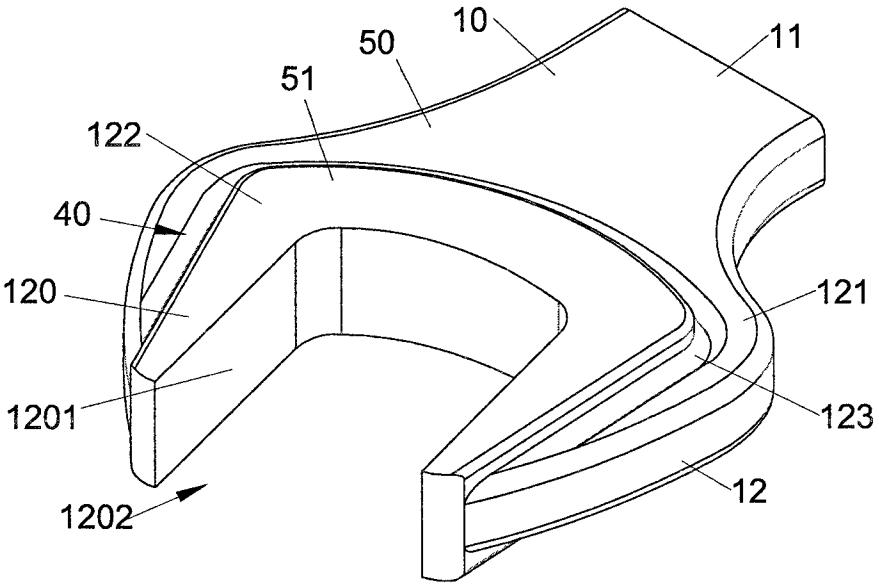
FIG. 1 is a perspective view to show the open wrench the of the present invention.
Figure 3:
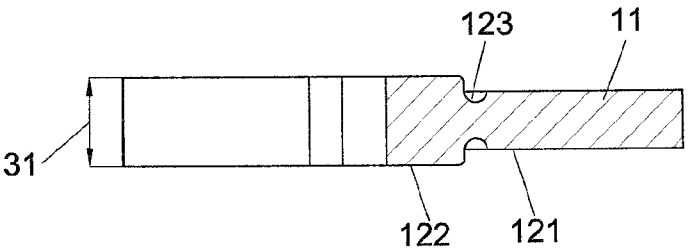
FIG. 3 is a cross sectional view, taken along line A-A in FIG. 2.
Figure 2:
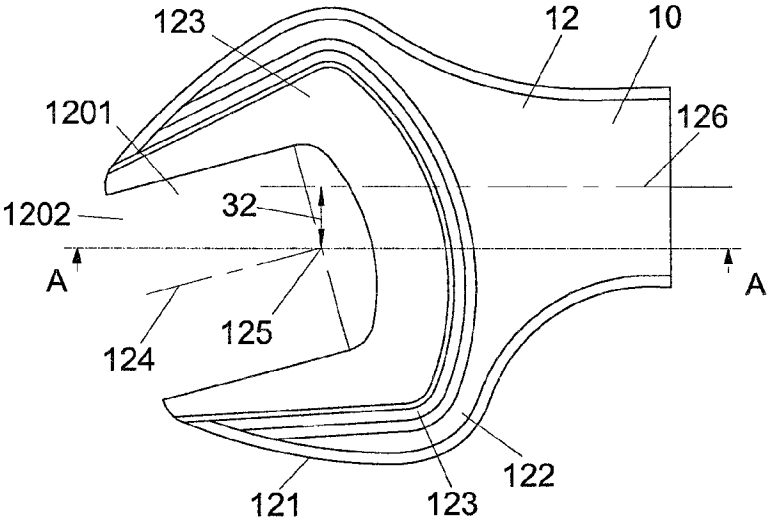
FIG. 2 is a top view to show the open wrench the of the present invention.

Referring to FIGS. 1 to 3, the open wrench 10 of the present invention comprises a handle 11 and a first driving head 12 is connected to the first end of the handle 11. The first driving head 12 has a U-shaped body 120 which has a mounting hole 1201 defined therein and an opening 1202 communicates with the mounting hole 1201. Each of top surface and bottom surface of the first driving head 12 has a first face 121 and a second face 122, wherein the height of the second face 122 is higher than that of the first face 121. The first and second faces 121, 122 are parallel to a horizontal plane on which the handle 11 is located. The second face 122 is a U-shaped face and located along with the mounting hole 1201. The first face 121 is a U-shaped face and located outside of the second face 122. The area of the second face 122 is ⅓ to ⅔ of the area of the first area 121. A U-shaped groove 123 is defined between the first and second faces 121, 122. The groove 123 is filled with a plastic or rubber stuffing material 40 which has different color from that of the first driving head 12. The first face 121 is located on the same horizontal plane with the handle 11. A first distance 31 is defined between the two respective second faces 122 of the top surface and the bottom surface of the first driving head 12. The handle 11 has a central axis 126 and a mediate point is defined between two insides of the mounting hole 1201. The mounting hole 1201 has an axial axis 124 which passes through the mediate point 125 and is parallel to the horizontal plane. A shift distance 32 is defined by a minimum distance between the mediate point 125 to the central axis 126. The shift distance 32 is 2-7 mm, preferably, the shift distance 32 is 5 mm. An angle of 15 degrees is defined between the axial axis 124 and the central axis 126.

Figure 4:
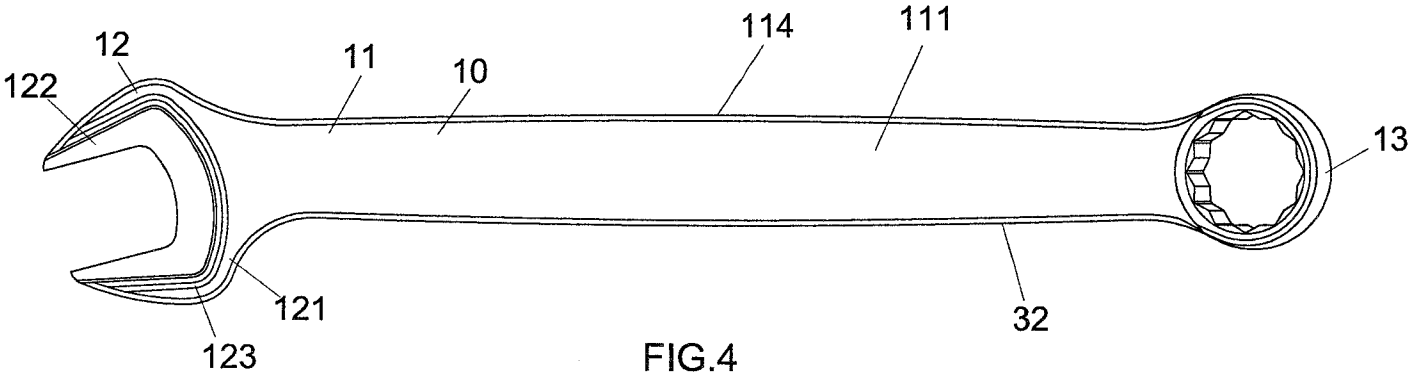
FIG. 4 is a top view to show the second embodiment of the open wrench the of the present invention.
Figure 5:
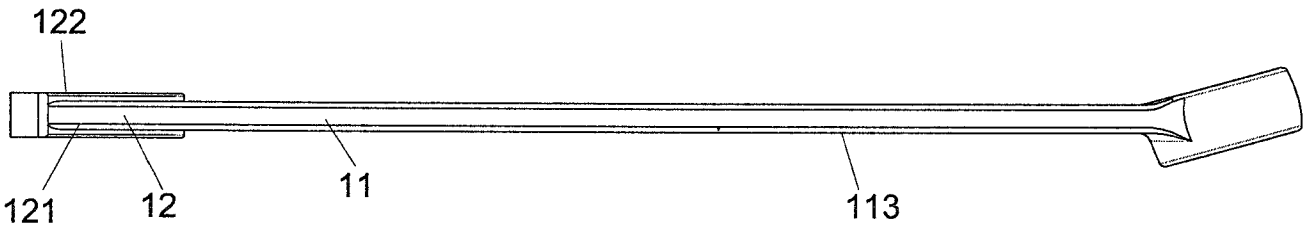
FIG. 5 is a side view to show the second embodiment of the open wrench the of the present invention.
Figure 6:
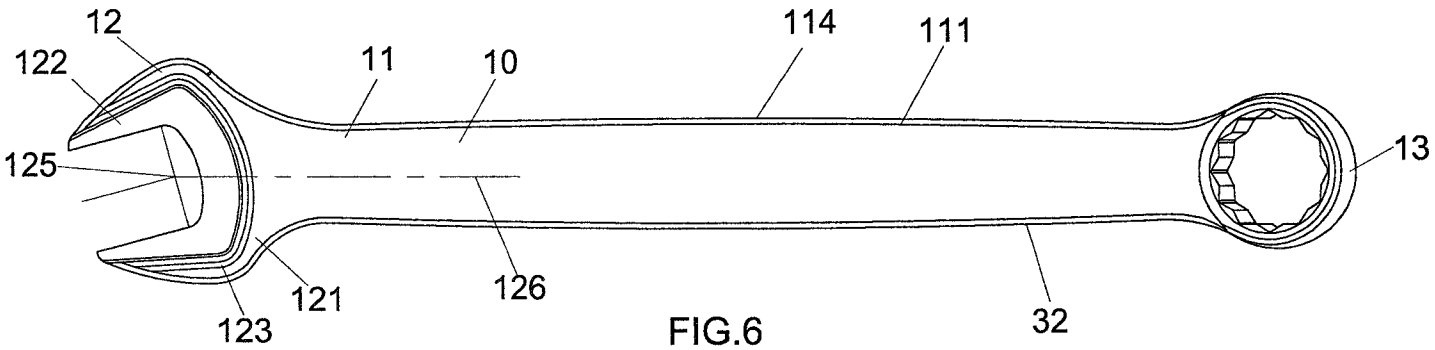
FIG. 6 is a top view to show the third embodiment of the open wrench the of the present invention.
Figure 7:
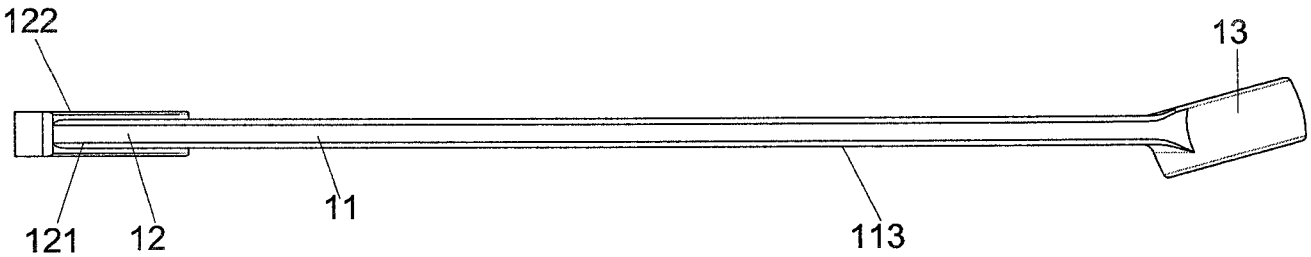
FIG. 7 is a side view to show the third embodiment of the open wrench the of the present invention.
Figure 8:
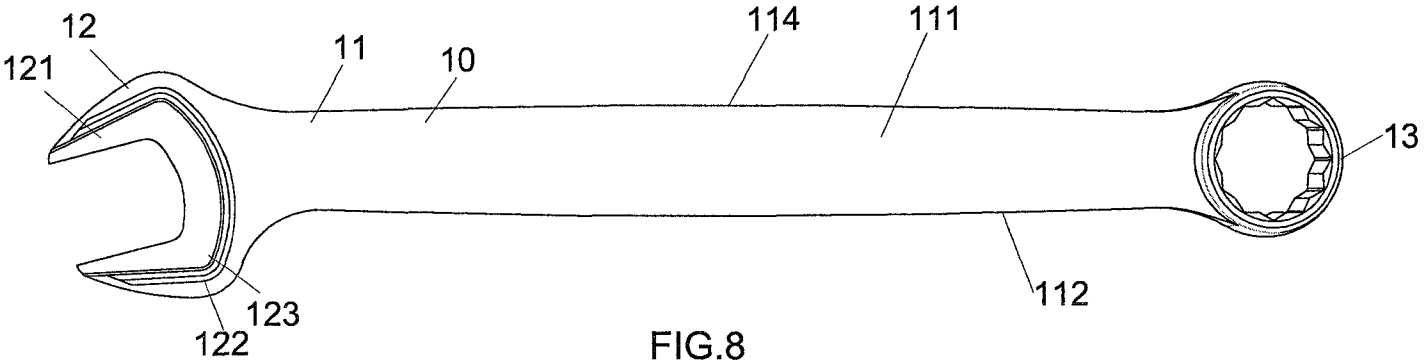
FIG. 8 is a top view to show the fourth embodiment of the open wrench the of the present invention.
Figure 9:
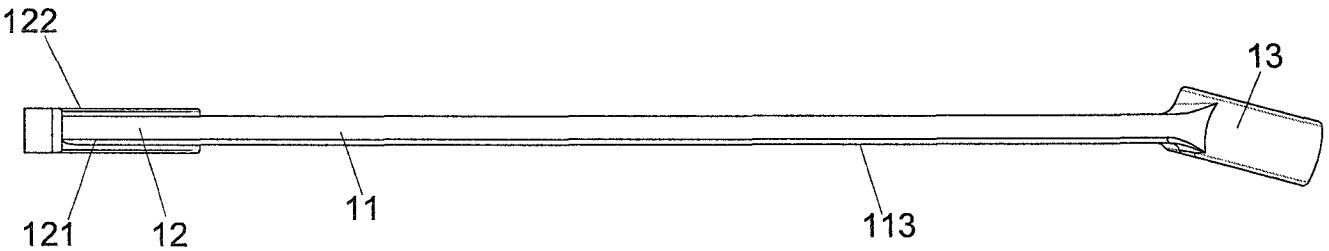
FIG. 9 is a side view to show the fourth embodiment of the open wrench the of the present invention.

As shown in FIGS. 4 and 5, the handle 11 has a first surface 111, a second surface 112, a third surface 113 and a fourth surface 114, wherein the first and third surfaces 111, 113 are wider than the second and fourth surfaces 112, 114. A second driving head 13 is connected to the second end of the handle 11. The second driving head 13 extends an angle relative to the first surface 111. The handle 11 has the maximum width at the middle section thereof and the width is gradually reduced toward the first and second ends of the handle 11. FIGS. 6 and 7 show that the mediate point 125 is located on the central axis 126. FIGS. 8 and 9 show that The second driving head 13 extends an angle relative to the third surface 113.

Figure 11:
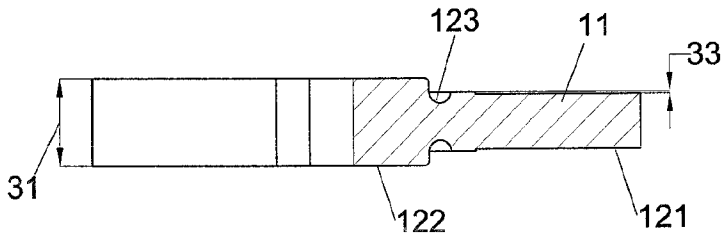
FIG. 11 is a cross sectional view, taken along line A-A in FIG. 10.
Figure 10:
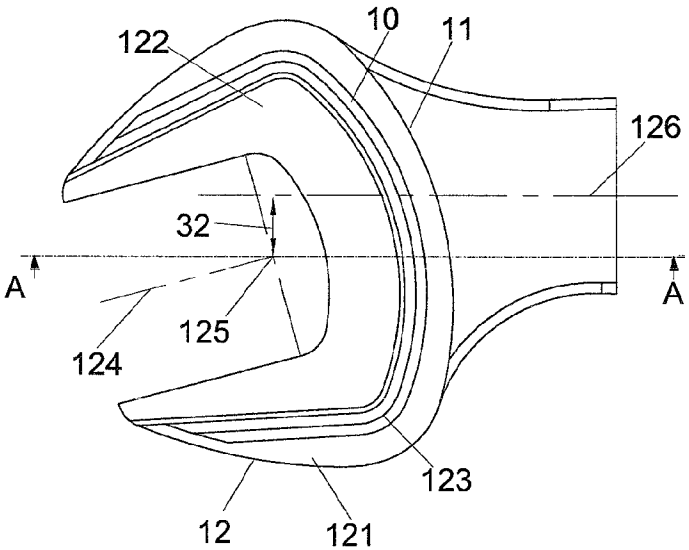
FIG. 10 is a top view to show the fifth embodiment of the open wrench the of the present invention.

FIGS. 10 and 11 show that a second distance 33 is defined between each of the first faces 121 of the first driving head 11 and each of the first and third surfaces 111, 113 of the handle 11. The second distance 33 is smaller than ⅕ of the distance between the two insides of the mounting hole 1201. Assume that the distance between the two insides of the mounting hole 1201 is 19 mm, the second distance 33 is smaller than 3.8 mm.

When the open wrench 10 is manufactured, the first driving head 12 has a first coating 50 applied thereto and the first coating 50 on the second face 122 is then removed, a second coating 51 is coated on the second face 122. The first and second coatings 50, 51 have different colors.

The second face 122 is higher than the first face 121 so that the thickness of the mounting hole 1201 is increased so as to reinforce the structural strength.

The groove 123 between the first and second faces 121, 122 makes the first driving head 12 have sufficient toughness.

The first driving head 12 has first and second faces 121, 122 and the groove 123 so as to reduce the weight and the material required.

The groove 123 is filled with stuffing material 40 which has different color from that of the first driving head 12 to increase attractiveness of the wrench.

While we have shown and described the embodiment in accordance with the present invention, it should be clear to those skilled in the art that further embodiments may be made without departing from the scope of the present invention.

What is claimed is:

1. An open wrench comprising:

a handle and a first driving head connected to a first end of the handle, the first driving head having a U-shaped body which has a mounting hole defined therein and an opening communicates with the mounting hole, each of top surface and bottom surface of the first driving head having a first face and a second face, a height of the second face being higher than that of the first face, the first and second faces being parallel to a horizontal plane, the second face being a U-shaped face and located along with the mounting hole, the first face being a U-shaped face and located outside of the second face, an area of the second face being ⅓ to ⅔ of an area of the first area, a U-shaped groove defined between the first and second faces, a first distance defined between the two respective second faces of the top surface and the bottom surface of the first driving head, the handle having a central axis, a mediate point defined between two insides of the mounting hole, the mounting hole having an axial axis which passes through the mediate point and is parallel to the horizontal plane, an angle of degrees defined between the axial axis and the central axis, the handle having a first surface, a second surface, a third surface and a fourth surface, the first and third surfaces being wider than the second and fourth surfaces, a second driving head connected to a second end of the handle, the second driving head extending an angle relative to the first surface, the handle having maximum width at a middle section thereof and a width being gradually reduced toward the first and second ends of the handle.

2. The open wrench as claimed in claim 1, wherein the two respective first faces of the top and bottom surfaces of the first driving head and the first and third surfaces of the handle are respectively located on the same planes.

3. The open wrench as claimed in claim 1, wherein the two respective first faces of the top and bottom surfaces of the first driving head are respectively higher than the first and third surfaces of the handle, a second distance is defined between each of the first faces of the first driving head and each of the first and third surfaces of the handle, the second distance is smaller than a distance between the two insides of the mounting hole.

4. The open wrench as claimed in claim 1, wherein the second distance is smaller than 1/10 of a distance between the two insides of the mounting hole.

5. The open wrench as claimed in claim 3, wherein the second distance is less than 2 mm.

6. The open wrench as claimed in claim 3, wherein the second distance is less than 1 mm.

7. The open wrench as claimed in claim 1, wherein an area of the second face is ½ of that of the first face.

8. The open wrench as claimed in claim 1, wherein a shift distance is defined by a minimum distance between the mediate point to the central axis.

9. The open wrench as claimed in claim 8, wherein the shift distance is 2-7 mm.

10. The open wrench as claimed in claim 8, wherein the shift distance is 5 mm.

11. The open wrench as claimed in claim 1, wherein the mediate point is located on the central axis.

12. The open wrench as claimed in claim 1, wherein the second driving head extends an angle relative to the third surface.

13. The open wrench as claimed in claim 1, wherein the groove is filled with a plastic or rubber stuffing material which has different color from that of the first driving head.

14. The open wrench as claimed in claim 1, wherein the first driving head has a first coating applied thereto and the first coating on the second face is removed, a second coating is coated on the second face, the first and second coatings have different colors.

* * * * *